United States Patent [19]

Murphy et al.

[11] 4,274,917

[45] Jun. 23, 1981

[54] PAPER PRODUCTS

[75] Inventors: Clarence R. Murphy; S. Paul Thackabeery, both of Houston, Tex.; Robert E. Boehme, deceased, late of Houston, Tex.; by Helen J. Boehme, sole beneficiary, Kalamazoo, Mich.

[73] Assignee: Gulf Oil Corporation, Pittsburgh, Pa.

[21] Appl. No.: 16,060

[22] Filed: Feb. 28, 1979

[51] Int. Cl.[3] ..... D21H 5/12

[52] U.S. Cl. ..... 162/146; 162/182

[58] Field of Search ..... 162/157 R, 146, 168 R, 162/182; 264/69, 140, 8, 9, 5; 260/29.6 WA, 29.6 XA, 897 B; 528/496

[56] References Cited

U.S. PATENT DOCUMENTS

| | | | |
|---|---|---|---|
| 3,848,027 | 11/1974 | Forbess et al. | 162/157 R |
| 4,013,751 | 3/1977 | Davis et al. | 162/157 R |
| 4,028,452 | 6/1977 | Driscoll | 162/157 R |
| 4,049,492 | 9/1977 | Lare | 162/157 R |
| 4,134,931 | 1/1979 | Hayes et al. | 162/157 R |

*Primary Examiner*—Peter Chin

*Attorney, Agent, or Firm*—Richard L. Kelly

[57] ABSTRACT

Paper having improved properties, particularly tear strength, is prepared from a furnish containing at least 90 weight % of cellulose fibers and up to 10 weight % of olefin polymer fibrils. The fibrils are prepared by a differential temperature process of the type described in U.S. Pat. No. 4,013,751, are refined in isopropanol, and are treated with an aqueous solution of polyvinyl alcohol to sorb at least 1.0 weight % of polyvinyl alcohol on the fibrils. The fibrils are prepared from an olefin polymer having a weight average molecular weight of at least one (1) million.

8 Claims, No Drawings

PAPER PRODUCTS

BACKGROUND OF THE INVENTION

It is known that the properties of paper are affected by the particular pulp employed and the degree of refining carried out on the pulp. It also is known that certain properties such as tear strength reach maximum values at relatively low refining levels. Such papers tend to have relatively low tensile strengths. By increasing the refining level, the tensile strength can be increased with a concomitant loss of tears strength. Other properties such as opacity, fold resistance, compressibility, and surface properties also are affected by the level of pulp refining. Accordingly, in the manufacture of most paper products, the manufacturer must trade off certain properties to optimize other properties considered more important for certain end use applications. Frequently blends of two or more pulps will be employed to obtain a desired balance of properties.

For the above reasons, the art is constantly seeking methods for obtaining a better balance of overall properties in paper which requires smaller trade offs in desired properties.

SUMMARY OF THE INVENTION

The invention is directed to novel paper products, and to methods for preparing such paper products that have a good balance of important properties such as tear strength, tensile strength, elongation, opacity, and tensile energy adsorption. In particular, the papers of the invention have higher tear strength than normally obtained from the particular pulp employed in their preparation.

The papers of the invention are prepared by preparing a furnish containing at least 90 weight % of cellulose pulp and up to about 10 weight % of a special type of olefin polymer fibril.* The fibrils are prepared from an olefin polymer having a weight average molecular weight of at least one million and are prepared by a process in which a hot solution of the olefin polymer is subjected to high shearing forces to orient the solute polymer molecules in the solvent and immediately thereafter the polymer solution is cooled to precipitate fibrils therefrom. The fibrils then are refined in an oxygen containing liquid such as isopropanol and subsequently treated with an aqueous solution of polyvinyl alcohol under high shearing forces so as to adsorb at least about 1.0 weight % of polyvinyl alcohol on the fibrils.

* Hereinafter, for brevity of expression, the olefin polymer fibrils frequently will be referred simply as "fibrils."

DETAILED DESCRIPTION OF THE INVENTION

In the broadest embodiment of the invention, the products of the invention are water-laid paper sheets containing at least 90 weight % of cellulose paper making fibers and up to about 10 weight % of a specific class of olefin polymer fibrils. The fibrils can be employed in an amount of about 0.5–10 weight %, preferably about 2–8 weight %, and especially about 4–6 weight %, said percentages being based on the combined weight of the cellulose fibers and fibrils. With certain types of cellulose pulps, fibrils can be employed in excess of 10 weight % of the total fibers to obtain still greater improvements in certain paper properties. The further improvements obtained, with most pulps, tend to be marginal and on the basis of present price relationships between pulps and olefin polymers are not justified on an economic basis.

The process of the invention consists of forming a furnish of cellulose fibers and fibrils and forming a water-laid sheet therefrom employing conventional paper making processes. In addition to the mixture of cellulose fibers and fibrils, conventional additives such as pigments, sizing agents and the like can be included in the furnish. While the furnish can be prepared by numerous techniques that will be obvious to those skilled in the art, it is presently preferred to first prepare a furnish of the cellulose fibers employing the techniques and degree of refining most appropriate for the particular cellulose pulp being employed. In a separate operation, the fibrils will be suspended, dispersed and refined in an aqueous medium. The fibril furnish then will be dispersed in an appropriate quantity in the cellulose furnish and the mixed furnish then will be lightly refined to prepare an intimate and homogeneous dispersion of the cellulose fibers and fibrils in the aqueous medium.

Essentially any type of cellulose pulp* can be employed in the practice of the invention, including mechanical pulps such as ground wood pulp, chemimechanical pulps, semichemical pulps, and chemical pulps such as kraft pulps. For a more detailed description of suitable pulps, see Kirk-Othner "Encyclopedia of Chemical Technology," Second Edition, Volume 16, Pages 680–726, which descriptions are incorporated herein by reference. Mixtures of two or more different pulps may be employed in the practice of the invention.

*Hereinafter, for brevity of expression, cellulose pulp frequently will be referred to simply as "pulps."

While it has been observed that the special fibrils employed in the present invention, when mixed with a wide variety of different types of pulp, provide papers having one or more improved strength properties—compared with paper prepared entirely from the cellulose pulp—, the degree of improvement is somewhat dependent upon the particular pulp employed. The greatest technical and economic benefits presently visualized are obtained when the fibrils are blended with pulps which customarily give papers having relatively low tear values. It has been demonstrated that the addition of as little as 5 weight % of fibrils to 95 weight % of certain hardwood kraft pulps will give papers having tear values up to 40% higher than corresponding values obtained with paper prepared from 100% of the pulp. It is known that papers prepared from certain groundwood pulps have tear values so low that they cannot be measured. The addition of 5 weight % fibrils to 95 weight % of such groundwood pulps provides papers having tear values of 10–20 grams per sheet.

The type of fibrils employed in the invention is critical as little or no improvement in tear or tensile strength properties is obtained with many types of fibrils reported in the art and presently offered for sale.

One critical parameter of the fibrils is the molecular weight of the olefin polymer from which they are prepared. The olefin polymer should have a weight average molecular weight of at least 1 million and preferably at least 1.5 million.

The preferred species of olefin polymer for use in the fibrils is an ethylene polymer containing, on a weight basis, at least 90% of polymerized ethylene. Such ethylene polymers will be ethylene homopolymers or ethylene copolymers containing small quantities of a $C_4$ or higher olefin comonomer such as butene, hexene, styrene, a conjugated diene such as butadiene, or the like. A second species of suitable olefin polymers consists of propylene polymers containing, on a weight basis, at least 50% of polymerized propylene. Such propylene polymers will be propylene homopolymers, or propylene copolymers containing up to 50% of copolymerized ethylene. A listing of suitable olefin polymers, including polymer mixtures containing olefin polymers, suitable for use in the invention, is set forth in U.S. Pat. No. 4,013,751, which description is incorporated herein by reference.

The fibrils employed are prepared by a differential temperature precipitation process. The olefin polymer is dissolved in a suitable solvent such as a hydrocarbon or a halogenated hydrocarbon. The polymer concentration is set at the highest feasible level consistent with maintaining a solution viscosity that can be handled in the process. The level of polymer concentration that can be employed will be somewhat dependent upon the molecular weight of the olefin polymer. It is possible to employ solutions containing at least 1 and sometimes up to about 10 parts of olefin polymer per 100 parts of solvent. The fibrils are prepared by subjecting the hot polymer solution to high shearing forces to orient the solute polymer molecules in the solvent and immediately thereafter cooling the solution to precipitate fibrils therefrom. Several methods for preparing fibrils by this method are reported in the art, including U.S. Pat. No. 4,013,751; U.S. Pat. No. 4,125,584; U.S. Pat. No. 4,237,081; and U.S. Pat. No. 4,181,794; the descriptions of each of which are incorporated herein by reference. The fibrils prepared by the process described in the Kim et al application give greater improvements in the products of the invention than do fibrils prepared by alternate manufacturing processes.

The preferred fibril manufacturing process disclosed in the Kim et al application is a multistep process which consists essentially of:

a. Introducing an olefin polymer and a solvent therefor into a first zone,
b. heating said first zone to a temperature above the atmospheric boiling point of said solvent so as to maintain said olefin polymer in solution and to maintain said first zone under superatmospheric pressure,
c. transferring polymer solution from said first zone to a second zone through an elongated tube-like transfer member,
d. feeding a propanol to said second zone to maintain liquid propanol above the discharge orifice of the transfer member,
e. maintaining a temperature in said second zone such that:
   (i) the propanol is maintained in the liquid state, and
   (ii) the pressure is lower than the pressure in the first zone,
f. stirring the liquid propanol in said second zone,
g. precipitating olefin polymer in said second zone to form fibrils,
h. distilling at least a portion of the polymer solvent from said second zone,
i. removing a slurry of fibrils and propanol from said second zone,
j. flash distilling the bulk of any polymer solvent remaining in the slurry recovered in step (i),
k. passing the fibril-propanol slurry from step (j) through refining apparatus to refine the fibrils, and
l. recovering refined fibrils and propanol from the slurry of step (k).

The solvent employed in step (a) is characterized in (1) having the capacity of dissolving at least about 1.0 weight % of the olefin polymer at the temperature employed in step (b), (2) having the capacity of dissolving not more than about 0.2 weight % of the olefin polymer at ambient temperature when diluted with an equal volume of propanol, (3) having an atmospheric boiling point of less than about 65° C., and (4) not forming an azeotrope with the propanol employed in step (d).

The fibrils, after being prepared as described above, are refined in a low molecular weight oxygen containing liquid that is miscible with both hydrocarbons and water. The refining medium removes residual solvent from the fibrils and also appears to have a desirable effect on the morphology of the fibrils. The refining can be carried out in conventional refining equipment such as Waring Blendors, disc mills, and the like. The oxygen containing liquid refining medium can be an alcohol such as methanol or ethanol, a polyhydric compound such as ethylene glycol, propylene glycol, or glycerine, or a ketone such as acetone. A propanol such as n-propanol and especially isopropanol is the preferred compound for use as the refining medium.

The fibrils, after being refined as described above, are treated with an aqueous solution of polyvinyl alcohol (PVA) under high shearing forces to sorb at least about 1.0 weight %, and preferably at least about 4.0 weight % of polyvinyl alcohol on the fibrils. The precise manner in which the PVA becomes associated with the fibrils has not been established. In this application the term "sorb" will be used to denote this association. The percent of PVA sorbed can be established by pressing the treated fibrils into a film and determining the PVA content by infra-red analysis. Alternatively, the PVA content can be determined by acetylating the PVA with acetic anhydride in pyridine, followed by titration of the acetic acid produced. This method is reported at *Analytical Chemistry of Polymers, Part I,* Gordon Kline, ed., Interscience Publishers, N.Y., 1959, p. 481.

The PVA is sorbed on the fibrils by suspending the refined fibrils in an aqueous solution of PVA and subjecting the suspension to high shearing forces. On a laboratory scale, the treatment is conveniently effected in a Waring Blendor. On a larger scale, the treatment can be effected in a disc mill or like refiner with the clearance being set to provide high shear on the suspension. Another means for effecting the treatment is to stir the suspension of fibril in the PVA solution while subjecting the suspension to ultrasonic vibrations. This method of treatment is described in U.S. Pat. No. 4,134,931, which description is incorporated herein by reference.

The polyvinyl alcohol solution employed will have dissolved therein about 2–15 and preferably about 4–10 weight % of the polymer. The weight ratio of fibrils to polyvinyl alcohol solution employed will be such that a minimum of 1 and preferably at least 10 parts of polyvinyl alcohol are present per 100 parts of the fibrils. The treatment can be carried out in a single step, or in multiple steps in which the fibrils are treated with fresh aliquots of the PVA solution. In all cases, the treatment will be such to sorb the minimum percent of PVA as previously set forth. The grade of polyvinyl alcohol employed in the process is not critical. Vinol 540 sold by Air Products and Chemicals provides satisfactory results.

The following examples are set forth to illustrate the principle and practice of the invention to those skilled in the art. Where parts or percentages are set forth, they are parts or percentages by weight unless otherwise indicated. All paper properties were obtained using TAPPI procedures and values are reported on a factored basis, i.e., the measured value is divided by the basis weight of the sheet.

EXAMPLE 1

A paper was prepared from a blend of 95 weight % of a hardwood kraft pulp supplied from Champion International and 5 weight % of fibrils. The fibrils were prepared by the process described in U.S. Pat. No. 4,181,794, by injecting a 2 weight % solution of an ethylene homopolymer (weight average molecular weight of about 1.5 million) dissolved in methylene chloride from a high temperature, high pressure zone (pressure of about 33 atmospheres—temperature about 150° C.) into a stirred bath of isopropanol maintained at atmospheric pressure and about 4° C. After being refined in isopropanol, the fibrils were refined in an aqueous PVA solution in a Waring Blendor to sorb about 4.0 weight % PVA on the fibrils.

The PVA-treated fibrils were slurried in water to prepare a suspension containing 1 weight % of solids. This suspension was refined for 2 minutes in a Waring Blendor. Five (5) parts of this suspension were added to 95 parts of a 1% suspension of the hardwood pulp in water. The mixed furnish then was refined for 1.5 minutes in a laboratory size Mead refiner. Hand sheets were made on a Noble & Wood sheet machine.

The properties of the dried sheets prepared from the mixed furnish and sheets prepared from the hardwood kraft pulp are shown in Table I.

TABLE I

| Sample | 100% Hardwood Kraft | 95% Hardwood Kraft-5% Fibrils |
|---|---|---|
| Basis wt, g/m$^2$ | 61 | 61 |
| Tear, g/sheet | 95 | 105 |
| Tensile, lb/inch | 18 | 20 |
| TEA*, ft-lb/ft$^2$ | 4 | 4 |
| Elongation, % | 4 | 4 |

*Tensile Energy Absorption

The fibrils increase both the tear strength and the tensile strength by about 11%.

EXAMPLE 2

Additional paper sheets were prepared from 95 weight % of the hardwood kraft pulp of Example 1 and 5 weight % of the fibrils of Example 1. In this example, different refining conditions were employed. In Run A (a control) a 1% furnish of the hardwood raft pulp was refined for 2 minutes in a Waring Blendor. In Run B (also a control) a 1% furnish of the hardwood kraft pulp was refined for 4 minutes in a Waring Blendor. In Run C, a 1% furnish of the fibrils was refined for 1 minute in a Waring Blendor. Five (5) parts of this furnish were added to 95 parts of a 1% furnish of the hardwood kraft pulp. The mixed furnish then was refined for 2 minutes in the Waring Blendor. Run D was identical to Run C except that the mixed furnish was refined for 4 minutes in the Waring Blendor. Run E was identical to Run C except that the fibrils were refined for 2 minutes in the Waring Blendor. The properties of sheets prepared from these furnishes are shown in Table II.

TABLE II

| Run | A (Control) | B (Control) | C | D | E |
|---|---|---|---|---|---|
| Basis wt, g/m$^2$ | 48 | 47 | 52 | 62 | 57 |
| Tear, g/sheet | 60 | 58 | 85 | 101 | 85 |
| Tensile, lb/inch | 18 | 17 | 13 | 17 | 16 |
| TEA, ft-lbs/ft$^2$ | 2.8 | 2.4 | 1.8 | 2.7 | 2.5 |
| Elongation, % | 3.5 | 3.5 | 2.9 | 2.8 | 3.1 |

The data show that the fibrils provide a very significant increase in tear strength as compared with the controls. The variation of Tear, Tensile, and TEA in Runs C, D, and E suggests that a somewhat better balance of properties can be obtained by optimizing the refining conditions for the mixed furnish.

EXAMPLE 3

Paper sheets were prepared from a softwood kraft pulp supplied by St. Regis Paper Company with a Hinton Hi-Brite designation and the fibrils described in Example 1. In Run A (a control) a 1% furnish of the soft wood pulp was refined in a Waring Blendor to a Canadian Freeness of 500. In Run B, the fibrils were slurried to form a 1% furnish, but the furnish was not refined. Five (5) parts of the fibril furnish was added to 95 parts of the softwood pulp furnish. The mixed pulp then was refined in a Waring Blendor to a Canadian Freeness of 500. Runs C, D, and E were identical to Run B except that the fibril furnish was refined in a Waring Blendor for 4 minutes (Run C), 8 minutes (Run D), or 12 minutes (Run E) before being added to the softwood furnish. The properties of sheets prepared from these furnishes are shown in Table III.

TABLE III

| Run | A (Control) | B | C | D | E |
|---|---|---|---|---|---|
| Basis wt, g/m$^2$ | 62 | 62 | 61 | 60 | 60 |
| Tear, g/sheet | 119 | 129 | 130 | 140 | 142 |
| Tensile, lb/inch | 51 | 48 | 47 | 47 | 47 |
| TEA, ft-lbs/ft$^2$ | 17 | 16 | 16 | 16 | 16 |
| Elongation, % | 7 | 7 | 7 | 7 | 7 |

It is seen that with this system, the inclusion of the fibrils in the sheet significantly improves the tear strength with a very modest decrease in tensile. The tear strength increased with an extension of the time of fibril refining before blending the fibrils with the cellulose furnish.

EXAMPLE 4

Paper prepared from a pulp mixture consisting of 60 weight % of a ground wood pulp and 40 weight % of a soft wood pulp had a tear strength factor of 87 grams per sheet. A second paper prepared by replacing 5 weight % of the soft wood pulp with fibrils had a tear strength factor of 94 grams per sheet. The fibrils employed were prepared by the process of Example 1 of U.S. Pat. No. 4,013,751 and were treated so that about 4.0% PVA was sorbed thereon. The ethylene polymer employed in the preparation of the fibrils was an ethylene homopolymer having a weight average molecular weight in excess of 1 million.

EXAMPLE 5

A lot of fibrils was prepared from an ethylene homopolymer having a weight average molecular weight well in excess of 1 million by the process described in U.S. Pat. No. 4,237,081. The fibrils were refined in isopropanol and then treated with an aqueous PVA solution to sorb about 4.0 weight % PVA on the fibrils.

An aliquot of these fibrils was delivered to representatives of a paper company for evaluation as a tear strength improving additive for addition to a hardwood pulp. The fibrils were evaluated in such a pulp to replace, respectively, 5 and 10 weight % of the pulp. The tear strength of paper prepared from the experimental pulps and a control prepared entirely from the hardwood pulp are shown in Table IV.

TABLE IV

| Sample | 100% Hardwood Pulp | 95% Hardwood Pulp 5% Fibrils | 90% Hardwood Pulp 10% Fibrils |
|---|---|---|---|
| Basis wt, g/m$^2$ | 57.4 | 59.8 | 58.0 |
| Tear, g/sheet | 69.2 | 85.6 | 97.1 |

EXAMPLE 6

Papers were made from furnishes consisting of 95 weight % of a hardwood pulp and 5 weight % of fibrils employing a modified refining process. One percent (1%) furnishes of the hardwood pulp and the fibrils were first prepared in a Waring Blendor. They then were mixed in a 95/5 weight ratio. The mixed furnishes then were refrigerated to 5.5° C. (10° F.) and refined to a Canadian Freeness of approximately 500.

Run A (a control) was made with 100% of the cellulose pulp. Run B was made with the fibrils described in Example 1. Run C was made with a second lot of fibrils prepared by the same process as the fibrils described in Example 1, except that the fibrils were prepared from a solution of the ethylene homopolymer dissolved in cyclohexane. The properties of the papers are shown in Table V.

TABLE V

| Run | A | B | C |
|---|---|---|---|
| Tear, g/sheet | 82 | 123 | 112 |
| Tensile, lb/inch | 17 | 19 | 18 |
| TEA, ft-lbs/ft$^2$ | 3 | 4 | 4 |
| Elongation, % | 2 | 4 | 4 |

As noted earlier herein, the improvement in paper properties obtained by the present invention are obtained only when the fibrils included in the water-laid sheet are prepared by the procedures described and have sorbed thereon the stated minimum percentage of PVA. As noted in the working examples, the inclusion of the fibrils in the water-laid sheets under the experimental conditions described invariably improves the tear strength of the sheets. As of the filing date of this application, fibrils prepared from polyethylene are offered for sale in several grades by several suppliers other than the assignee. The substitution of any of these commercial fibrils for the applicants' fibrils in the examples set forth above gives water-laid sheets having tear values lower than the tear values of the controls prepared from 100% of the cellulose pulp.

By reason of the process by which the fibrils employed in the invention are prepared, it is possible to make many modifications of the fibrils. By way of example, certain inorganic pigments, fillers, and the like can be incorporated into the polymer solution and remain physically encapsulated within the polymer fibrils when they are precipitated. Typical of the pigments that can be employed for this purpose include titanium dioxide, silica, calcium carbonate, calcium sulfate, and the like. Waterlaid sheets prepared from such modified fibrils have enhanced opacity, improved printing characteristics, high water resistance, and the like.

In the examples, the applicants have shown the improvements obtained by adding small quantities of fibrils to a number of different types of cellulose pulps. In commercial practice, it is visualized that papers having a good balance of properties will be prepared by adding fibrils to cellulose pulp mixtures containing a softwood kraft pulp mixed with a hardwood kraft pulp or a groundwood pulp or a mixture of hardwood kraft and groundwood pulps. Such cellulose pulp mixtures typically will contain 25–75 weight % of softwood kraft with the balance being either hardwood kraft, or a groundwood or a mixture thereof.

What is claimed:

1. A process for improving the tear strength of water-laid cellulose paper sheets prepared from a cellulose furnish which consists essentially of preparing a furnish consisting essentially of at least 90 weight % of a cellulose pulp and about 0.5–10 weight % of olefin polymer fibrils, and forming a water-laid sheet from said furnish; said olefin polymer fibrils being incorporated in the furnish in an amount sufficient to improve the tear strength of water-laid sheet prepared from said furnish; said olefin polymer fibrils having been prepared by a process in which:

(a) the fibrils were prepared from an olefin polymer having a weight average molecular weight of at least one million, (b) the fibrils were prepared by a multistep process consisting essentially of:

(1) introducing an olefin polymer and a solvent therefor into a first zone, (2) heating said first zone to a temperature above the atmospheric boiling point of said solvent so as to maintain said olefin polymer in solution and to maintain said first zone under superatmospheric pressure, (3) transferring polymer solution from said first zone to a second zone through an elongated tube like transfer member, (4) feeding a propanol to said second zone to maintain liquid propanol above the discharge orifice of the transfer member, (5) maintaining a temperature in said second zone such that:

(i) the propanol is maintained in the liquid state, and (ii) the pressure is lower than the pressure in the first zone, (6) stirring the liquid propanol in said second zone, (7) precipitating olefin polymer in said second zone to form fibrils, (8) distilling at least a portion of the polymer solvent from said second zone, (9) removing a slurry of fibrils and propanol from said second zone,

(10) flash distilling the bulk of any polymer solvent remaining in the slurry recovered in step (9),

(11) passing the fibril-propanol slurry from step (10) through refining apparatus to refine the fibrils, and

(12) recovering refined fibrils and propanol from the slurry of step (11), the solvent employed in step (1) being characterized in (i) having the capacity of dissolving at least about 1.0 weight % of the olefin polymer at the temperature employed in step (2), (ii) having the capacity of dissolving not more than about 0.2 weight % of the olefin polymer at ambient temperature when diluted with an equal volume of propanol, (ii) having an atmospheric boiling point of less than about 65° C., and (iv) not forming an azeotrope with the propanol employed in step (4), (c) the fibrils from step (b) were refined in a low molecular weight oxygen containing liquid that is miscible with both hydrocarbons and water, and (d) the refined fibrils of step (c) were treated in an aqueous solution of polyvinyl alcohol under high shearing forces so as to sorb at least 1.0% of polyvinyl alcohol on said fibrils.

2. A process of claim 1 in which the cellulose pulp consists predominantly of a chemical pulp.

3. A process of claim 2 in which the cellulose pulp consists predominantly of a hardwood pulp.

4. A process of claim 3 in which the pulp consists predominantly of a kraft pulp.

5. A process of claim 2 in which the cellulose pulp consists predominantly of a softwood pulp.

6. A process of claim 5 in which the pulp consists predominantly of a kraft pulp.

7. A process of claim 1 in which the cellulose pulp consists of a mixture containing 25–75 weight % of a softwood kraft pulp and the balance a groundwood pulp, or a hardwood kraft pulp or a mixture of a groundwood pulp and a hardwood kraft pulp.

8. A process of claim 1, 2, 3, 4, 5, 6, or 7 in which the fibrils were refined in isopropanol.

* * * * *